US010441082B2

(12) United States Patent
Huang

(10) Patent No.: US 10,441,082 B2
(45) Date of Patent: Oct. 15, 2019

(54) CHAIR CAPABLE OF INSTALLING A HANDLE FREELY

(71) Applicant: Tsung-Chieh Huang, Kaohsiung (TW)

(72) Inventor: Tsung-Chieh Huang, Kaohsiung (TW)

( * ) Notice: Subject to any disclaimer, the term of this patent is extended or adjusted under 35 U.S.C. 154(b) by 35 days.

(21) Appl. No.: 15/838,367

(22) Filed: Dec. 12, 2017

(65) Prior Publication Data

US 2019/0174925 A1 Jun. 13, 2019

(51) Int. Cl.
*A47C 7/54* (2006.01)

(52) U.S. Cl.
CPC ..... *A47C 7/546* (2013.01); *A47C 7/543* (2013.01)

(58) Field of Classification Search
None
See application file for complete search history.

(56) References Cited

U.S. PATENT DOCUMENTS 3,950,027 A * 4/1976 Wilson ..... A47C 7/543 297/411.27
4,850,647 A * 7/1989 Engel ..... A47C 3/00 297/446.1
5,281,001 A * 1/1994 Bergsten ..... A47B 21/0371 248/118
6,131,992 A * 10/2000 Chang ..... A47C 4/20 297/55
6,616,223 B1 * 9/2003 Lin ..... A47C 4/44 297/16.1
7,255,402 B1 * 8/2007 Haddad ..... B60N 2/76 297/411.32
8,322,787 B2 * 12/2012 Smith ..... A47C 1/124 248/230.5
8,567,863 B2 * 10/2013 Hetzel ..... A61G 5/1067 297/284.4
2003/0155797 A1 * 8/2003 Amirault ..... B60N 2/2851 297/250.1
2004/0189059 A1 * 9/2004 Yang ..... A47C 4/10 297/16.2
2011/0080031 A1 * 4/2011 Whelan ..... A61G 5/10 297/440.2
2017/0340120 A1 * 11/2017 Chen ..... A47C 4/20

* cited by examiner

*Primary Examiner* — David E Allred

(57) ABSTRACT

A chair capable of installing a handle freely, comprising: a chair frame formed by two symmetrical sub-frame; each sub-frame including a supporting bar and an assembly bar bending from the supporting bar; one end of the assembly being formed with a hollow space for being inserted by a handle; a seat supported by the chair frame and installed between the two sub-frame. Each chair back has two sleeves at two sides thereof; each sleeve enclosing a respective one of the assembly bars; and a retainer for fixing the sleeve to the assembly bar of the frame. The chair further comprises at least one rotatable handle; for each chair frame, a shaft being inserted into a hollow space of the assembly bar of the frame; and a pivotal device is used to pivotally install the handle and the shaft, and a supporting plate is installed on the shaft.

3 Claims, 3 Drawing Sheets

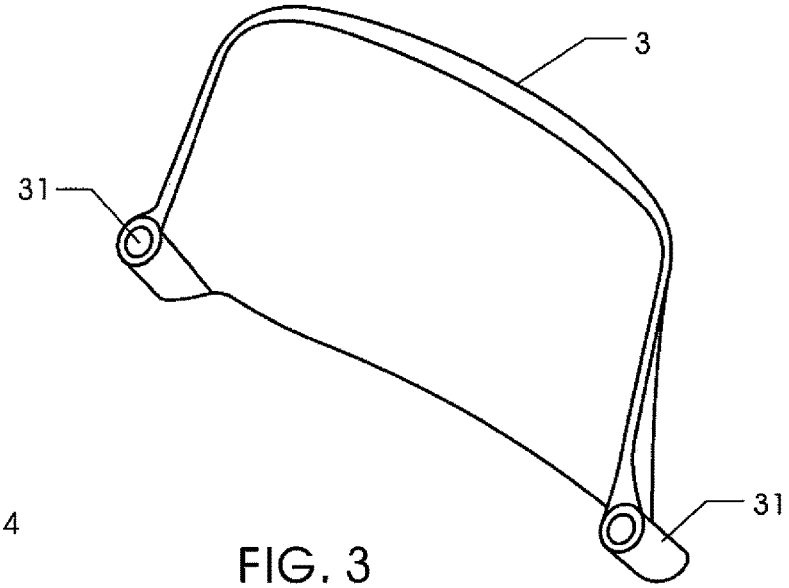
FIG. 3
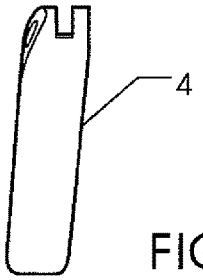
FIG. 5
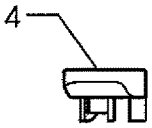
FIG. 4
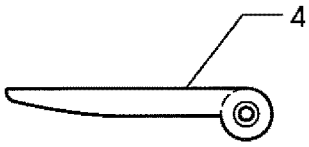
FIG. 6
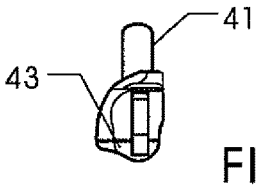
FIG, 8
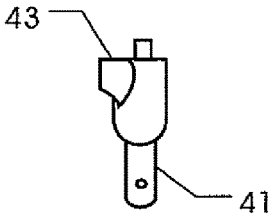
FIG. 7
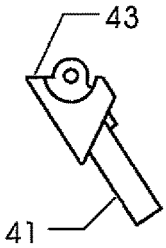
FIG. 9
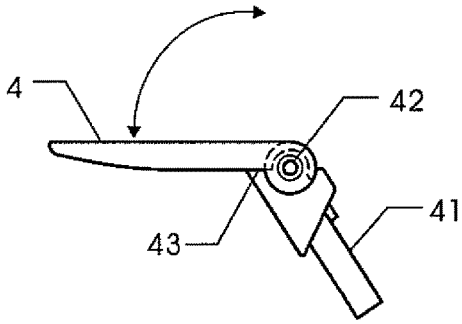
FIG. 10

CHAIR CAPABLE OF INSTALLING A HANDLE FREELY

FIELD OF THE INVENTION

The present invention is related to chairs, and in particular to a chair capable of installing a handle freely.

BACKGROUND OF THE INVENTION

In the prior art, for a chair having a handle, the combination and fixedness of the handle with the chair frame is completed in the assembly process. Therefore, after purchasing the chair, the handle is fixed to the chair frame, the buyer can be installed them by selecting the form he (or she) likes. As a result, the chair may be not so flexible, comfortable and convenient. Furthermore uses of the chair are limited.

However, the handles confine the movement of the user, while a chair without handles will cause the user's hands to suspend. However, chairs with handles and without handles are manufactured repeatedly will cause waste of resources and it causes inconvenient for users.

Therefore, there is an eager demand for a novel chair which can be assembled easily and firmly and the user can assembly the handle to the chair by himself.

SUMMARY OF THE INVENTION

To improve above mentioned defect in the prior art, the present invention provides a novel chair, wherein by the design of the present invention, the chair frame, chair back and handles can be assembly easily and quickly and the cost is low so that it is matched to the requirement of industry and is economic. The handles of the present invention are selectable and ergonometric and thus the user feel comfortable. Furthermore, the handle can be selected to be installed at one side or two sides of the chair and thus it is suitable to the requirement of the environment. Furthermore the user can installed the chair by himself or herself and thus the chair can be assembled, repaired and maintained easily and conveniently.

To achieve above object, the present invention provides a chair capable of installing a handle freely, comprising: a chair frame formed by two symmetrical sub-frame; each sub-frame including a supporting bar and an assembly bar bending from the supporting bar; one end of the assembly being formed with a hollow space for being inserted by a handle; a seat supported by the chair frame and installed between the two sub-frame; and a chair back installed to the two assembly bars of the chair frame.

Each chair back has two sleeves at two sides thereof; each sleeve enclosing a respective one of the assembly bars of the chair frame; and a retainer for fixing the sleeve to the assembly bar of the frame.

The chair further comprises at least one rotatable handle; for each chair frame, a shaft being inserted into a hollow space of the assembly bar of the frame; and a pivotal device is used to pivotally install the handle and the shaft, and a supporting plate is installed on the shaft.

BRIEF DESCRIPTION OF THE DRAWINGS

FIG. 3 shows the embodiment of chair back of the present invention.

FIG. 4 is a front view of the handle of the present invention.

FIG. 5 is an elevational view of FIG. 4.

FIG. 6 is a right side view of FIG. 4.

FIG. 7 is a front view about the shaft of the handle of the present invention.

FIG. 8 is an elevational view of FIG. 7.

FIG. 9 is a right side view of FIG. 7.

FIG. 10 is a schematic view about the action of an assembled handle.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
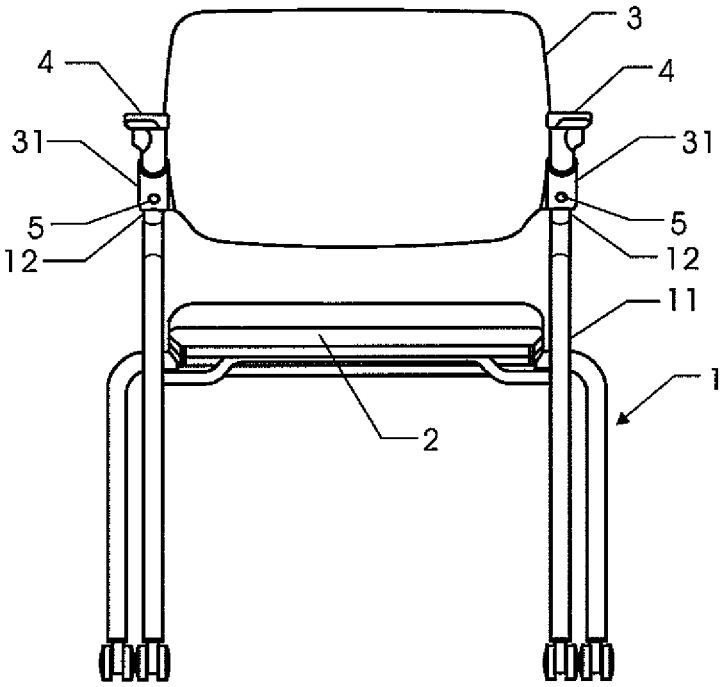
FIG. 1 shows the embodiment of the present invention.
Figure 2:
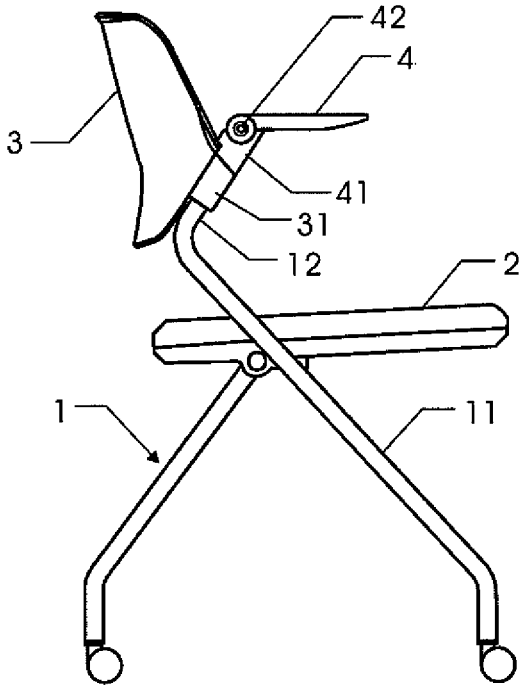
FIG. 2 is a left side view of FIG. 1.

With reference to FIGS. 1 and 2. the chair of the present invention includes the following elements.

A chair frame 1 is formed by two symmetrical sub-frames. Each sub-frame includes a supporting bar 11 and an assembly bar 12 bending from the supporting bar 11. One end of each assembly bar 12 is formed with a hollow space for being inserted by a handle;

A seat 2 is supported by the chair frame 1 and is installed between the two sub-frame.

A chair back 3 has two sleeves 31 at two sides thereof. Each sleeve 31 encloses a respective one of the assembly bars 12 of the chair frame 1. A retainer 5 serves to fix the sleeve 31 to the assembly bar 12 of the frame 1.

Two rotatable handles 4 are included. For each chair frame 1, a shaft 41 is inserted into a hollow cylinder of the assembly bar 12 of the frame 1. With reference to FIGS. 4 to 10, a pivotal device 42 is used to pivotally install the handle 4 and the shaft 41. With reference to FIGS. 7 to 10, a supporting plate 43 is installed on the shaft 41. The supporting plate 43 serves to resist against the handle 4 so that the handle 4 can be placed on a flat position.

Figure 11:
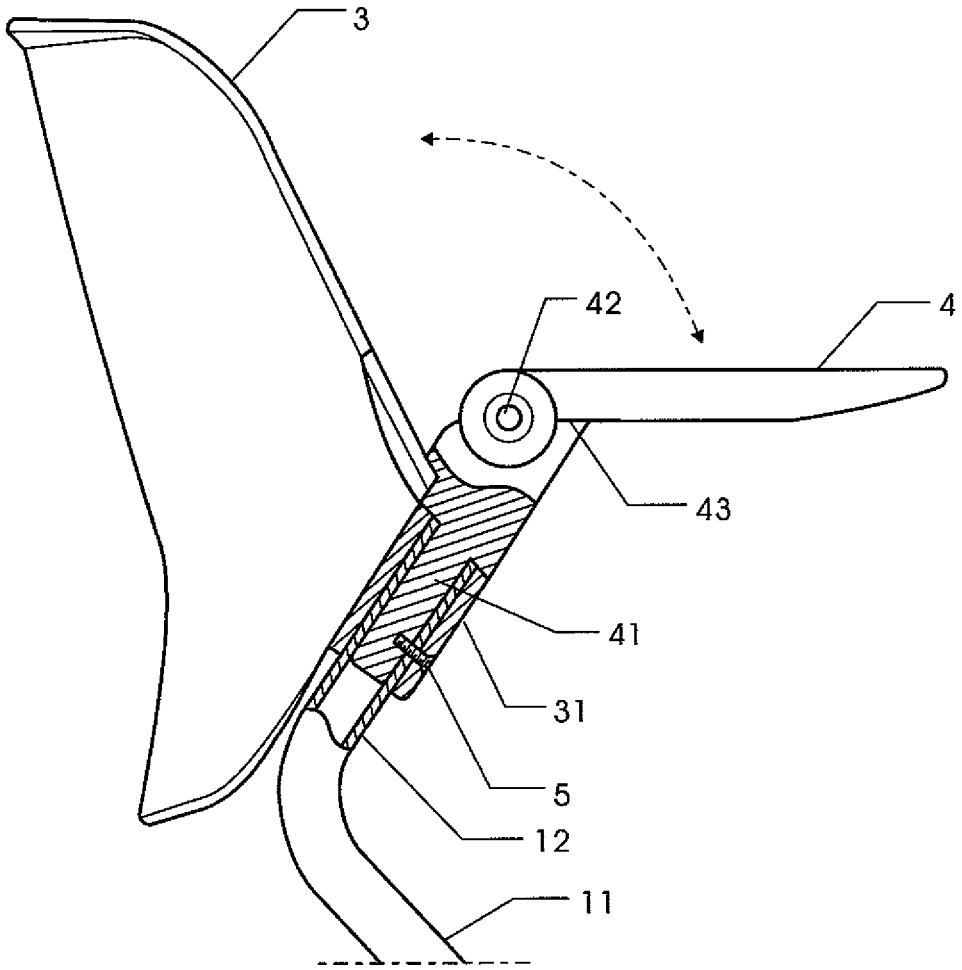
FIG. 11 is a cross sectional view showing the assemble of the chair frame, chair back and the handle.

With reference to FIG. 11, by the structure of the present invention, the chair frame, chair back and handle can be assembled easily and quickly, which is ergonomic and comfortable.

By the design of the present invention, the chair frame, chair back and handles can be assembly easily and quickly and the cost is low so that it is matched to the requirement of industry and is economic. The handles of the present invention are selectable and ergonometric and thus is suitable. Furthermore, the handle can be selected to be installed at one side or two sides and thus it can be suitable to the requirement of the environment. Furthermore the user can installed the chair by himself or herself and thus the chair can be assembled, repaired and maintained easily and conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A chair capable of installing a handle freely, comprising:

a chair frame formed by two symmetrical sub-frames, symmetrical relative to a central dividing plane of the chair; each sub-frame including a supporting bar and an assembly bar bending from the supporting bar; one end of the assembly bar being formed with a hollow space for being inserted by a handle;

a seat supported by the chair frame and installed between the two sub-frames; and a chair back installed to the two assembly bars of the chair frame;

wherein the chair back has two sleeves at two sides thereof; each sleeve enclosing a respective one of the assembly bars of the chair frame; and a retainer for fixing the sleeve to the assembly bar of the frame; and wherein the handle comprises a rotatable handle portion and a shaft portion including: a shaft received into the hollow space and a shoulder portion abutting an end edge of the assembly bar and an end edge of one of the sleeves.

2. The chair capable of installing a handle freely as claimed in claim 1, wherein the handle is one of a plurality of handles, the plurality of handles further comprising at least one rotatable handle for each chair frame; a shaft being inserted into each hollow space of the assembly bar of the frame; and a pivotal device interconnecting the rotatable handle and the shaft, and wherein the shaft comprises a supporting plate.

3. The chair capable of installing a handle freely as claimed in claim 2, wherein the supporting plate serves to resist rotation of the rotatable handle so that the rotatable handle is placed on a horizontally flat position.

* * * * *